US005574267A

United States Patent [19]

Palumbo

[11] Patent Number: 5,574,267

[45] Date of Patent: Nov. 12, 1996

[54] SWITCH WITH ENHANCED HEAT ELIMINATION

[76] Inventor: Nicholas R. Palumbo, 176 Prospect St., Providence, R.I. 02906

[21] Appl. No.: 559,761

[22] Filed: Nov. 13, 1995

[51] Int. Cl.[6] ..... H01H 1/06

[52] U.S. Cl. ..... 200/275; 200/246; 200/51 R; 439/850

[58] Field of Search ..... 200/275, 239, 200/253.1, 246, 51 R, 51.09; 439/845, 849, 850

[56] References Cited

U.S. PATENT DOCUMENTS

| | | | |
|---|---|---|---|
| 2,791,755 | 5/1957 | Hommell | 439/849 |
| 3,452,324 | 6/1969 | Fitzpatrick | 439/849 |
| 3,550,069 | 12/1970 | Teagnu | 439/849 |
| 4,506,119 | 3/1985 | Tanase | 200/275 |

*Primary Examiner*—David J. Walczak

[57] ABSTRACT

An external terminal end of an electrical element of a switch has a thick central portion providing enhanced elimination of heat generated by switching arcs to a connected female spade receptacle.

6 Claims, 1 Drawing Sheet

SWITCH WITH ENHANCED HEAT ELIMINATION

BRIEF SUMMARY OF THE INVENTION

This invention relates to electrical switches and particularly to the removal of heat generated within such switches.

Electric currents within switches generate heat and this heat must be removed to the environment of the switch to prevent switch elements from being heated to destructive temperature. The generation of heat within a switch is particularly concentrated at contacting regions of electrodes where transient arcs form during switching. The switch of the present invention provides an enhanced path for conduction of heat from contacting regions of electrodes within the housing of the switch to a spade receptacle external to the housing of the switch and which connects the switch to electrical circuitry.

DETAILED DESCRIPTION

Figure 1:
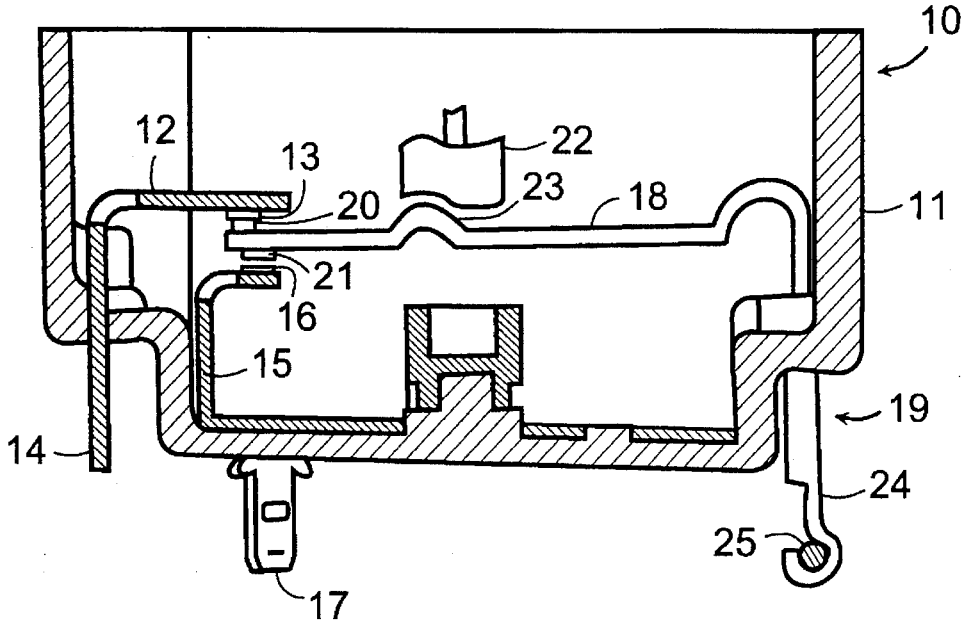
FIG. 1 shows in cross-section portions of a switch according to the invention.

Describing the invention with reference to the drawings, electrical switch 10 according to the invention has housing 11 made of electrically non-conductive material. Electrode 12 with contacting region 13 is supported within housing 11 and connected to electrical circuitry 14. Another electrode 15 with contacting region 16 is connected to electrical circuitry 17. Conductive element 18 has a generally ribbon-like form and is supported on housing 11 and passes through housing 11 with terminal end 19 outside of housing 11. Conductive element 18 has near its inside end contacting region 20 making contact with contacting region 13 of electrode 12 and contacting region 21 making contact with contacting region 16 of electrode 15. Cam 22 engages cam follower 23 providing a mechanism for bringing together and separating contacting regions 20 and 21 of conductive element 18 and contacting regions 13, 16 of electrodes 12 and 15.

Terminal end 19 of conductive element 19 extends to the outside of housing 11 and is inserted in female spade receptacle 24 which is attached by crimping to wire conductor 25 and thereby connecting the conductive element 18 to electrical circuitry.

Figure 2:
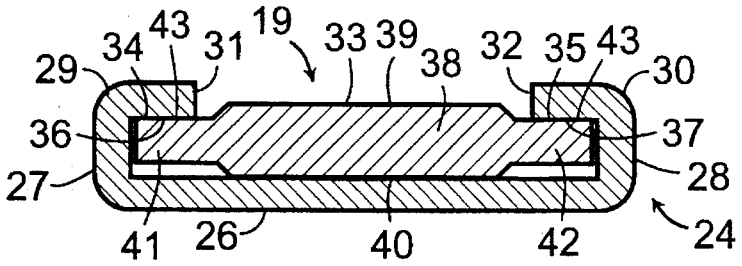
FIG. 2 shows a cross-sectional view of a terminal end of a conductive element of the switch of FIG. 1, the terminal end being inserted in a female spade receptacle.

As shown particularly in FIG. 2, female spade receptacle 24 has a bridge 26 connected on each side through spacer portions 27, 26 extending upwards from bridge 26 to rails 29, 30. Rails 29, 30 have clamping edges 31, 32 which extend from spacer portions 27, 28 to a position spaced from and opposed to bridge 26 to provide a gripping surface to hold terminal end 19.

Terminal end 19 has a width (this referring to the dimension running left-to-right in FIG. 2) greater than the space between clamping edges 31 and 32, and less than the space between spacer portions 27 and 28. Terminal end 19 includes a central portion 33 extending lengthwise (referring to the direction that is vertical in FIG. 1 and perpendicular to the paper in Fig 2) with edge portions 34 and 3S extending out from the side of the terminal end, the edge portions having a thickness (referring to the direction vertical in FIG. 2) less than that of the central portion. The width of the central portion 33 is less than the space between clamping edges 31 and 32, and the thickness of central portion 33 is greater than the space between gripping surfaces 36, 37 and bridge 26. The thickness of central portion is advantageously made the same as that of the interior portions of conductive element 18.

The cross-section of terminal end 19 of conductive element 19 has a cross-section as shown particularly in FIG. 2, with a central area 38 bounded by parallel lines 39 and 40 and edge areas 41 and 42 extending from opposite ends of central area 38 and bounded at their interfaces with clamping edges 31.32 by a line 43 parallel to and between lines 39 and 40.

The cross-section of terminal end 19 is, as shown in FIG. 2, advantageously made symmetrical about a line midway between lines 39 and 40 and passing through spacer portions 27 and 28 so that a spade receptacle can be attached in either of two orientations.

In operation, terminal end 19 is inserted in female spade receptacle 24 where it is clamped between rails 29, 30 bearing on edge portions 34,35 and bridge 26 bearing on the bottom of central portion 33. Heat generated at contacting regions 20,21 by arcs occurring during switching is conducted along conductive element 18 to its terminal end 19 where it is further conducted especially by thicker central portion 33 to the female spade receptacle and thence to the environment.

I claim:

1. An electrical switch including a housing of non-conducting material, an electrode with a contacting region, said electrode being supported within said housing and connected to electrical circuitry, a conductive element supported by and passing through said housing, said conductive element having a contacting region within said housing and a terminal end outside said housing, mechanism for bringing together and separating the contacting region of said electrode and the contacting region of said conductive element to effect switching, said terminal end being inserted in a female spade receptacle having a bridge connected on each side to a rail, each of said rails having a spacer portion extending upwards from said bridge and a clamping edge extending from said spacer portion and bending over to provide gripping surface opposed to said bridge, with a space between the gripping surface and the bridge, said terminal end having a width greater than a space between said clamping edges and less than a space between said spacer portions, said terminal end having two edge portions and a central portion lying between said edge portions, said edge portions and said central portion extending lengthwise along said terminal, said central portion having a width less than said space between said clamping edges and a thickness greater than the space between the gripping surface and the bridge, said two edge portions being thinner than said central portion, said edge portions fitting under and engaging said gripping surface while said central portion presses against said bridge, said conductive element enhancing conduction of heat from said contacting regions to structures exterior to said switch housing.

2. A switch as claimed in claim 1, wherein said conductive element has a generally ribbon-like form and wherein portions of said conductive element within said housing have a thickness equal to that of said central portion.

3. An electrical switch as claimed in claim 1, wherein said terminal end has a cross-section that is symmetrical about a plane passing through said spacer portions.

4. An electrical switch including a housing of non-conducting material, an electrode with a contacting region, said electrode being supported within said housing and connected to electrical circuitry, a conductive element supported by and passing through said housing, said conductive element having a contacting region within said housing and a terminal end outside said housing, said terminal end having a generally ribbon-like form with a longest dimension substantially greater than any other dimension, mechanism for bringing together and separating the contacting region of said electrode and the contacting region of said conductive element to effect switching, said terminal end having a cross-section perpendicular to said longest dimension with a central area bounded by a first line and a second line, said first and said second tine being parallel, said terminal end cross-section having a first edge area and a second edge area, said first and said second edge areas extending from opposite ends of said central area, said first and said second edge areas being bounded by a third line lying between said first and said second lines.

5. An electrical switch as claimed in claim 4, wherein said terminal end cross-section is symmetrical about a line midway between said first line and said second line.

6. An electrical switch as claimed in claim 4, wherein said conductive element has a generally ribbon-like form and wherein portions of said conductive element within said housing have a thickness equal to the distance between said first line and said second line.

* * * * *